US007111539B2

(12) United States Patent
Hards

(10) Patent No.: US 7,111,539 B2
(45) Date of Patent: Sep. 26, 2006

(54) VENEER CLIPPER ANVIL ROLL JACKET AND RELATED METHODOLOGY

(75) Inventor: John E. Hards, West Vancouver (CA)

(73) Assignee: Industrial Equipment Manufacturing, Ltd., Delta (CA)

( * ) Notice: Subject to any disclaimer, the term of this patent is extended or adjusted under 35 U.S.C. 154(b) by 287 days.

(21) Appl. No.: 10/717,014

(22) Filed: Nov. 19, 2003

(65) Prior Publication Data

US 2005/0115640 A1 Jun. 2, 2005

(51) Int. Cl.
*B26D 7/20* (2006.01)

(52) U.S. Cl. ..... 83/659; 492/45

(58) Field of Classification Search ..... 492/45, 492/56; 83/658, 659, 347
See application file for complete search history.

(56) References Cited

U.S. PATENT DOCUMENTS

| | | | | |
|---|---|---|---|---|
| 2,257,025 | A * | 9/1941 | Schuster | 492/45 |
| 2,715,879 | A * | 8/1955 | Sawyer | 492/45 |
| 3,184,828 | A * | 5/1965 | Dames, Jr. | 492/45 |
| 3,808,925 | A | 5/1974 | Hards | |
| 3,946,628 | A | 3/1976 | VanDerlin | |
| 3,952,370 | A * | 4/1976 | Greider | 452/45 |
| 4,041,820 | A | 8/1977 | McGee | |
| 4,130,041 | A | 12/1978 | McGee | |
| 4,658,684 | A | 4/1987 | Brookhyser | |
| 4,732,067 | A | 3/1988 | Yamada | |
| 4,910,845 | A * | 3/1990 | Delhaes | 29/895.2 |
| 5,058,473 | A | 10/1991 | Yamada | |
| 6,505,658 | B1 | 1/2003 | Koba | |

* cited by examiner

*Primary Examiner*—Stephen Choi
(74) *Attorney, Agent, or Firm*—Jon M. Dickinson PC; Robert D. Varitz PC

(57) ABSTRACT

Wear-replaceable resilient cover structure, or jacket, for the known-diameter cylindrical surface of an elongate, known-length anvil roll in a veneer clipper. The cover structure includes an elongate, internal, tubular, cylindrical armature having inside and outside diameters which are each larger than an anvil roll's surface's known diameter, and an elongate, tubular, cylindrical resiliency sleeve which embeddedly receives, and is stabilized by, the armature. The sleeve possesses inside and outside diameters which are, respectively, less than and greater than those of the armature, and the sleeve's inside diameter is sized to promote non-bonding, resistive slide-on/slide-off fitment of the armature-stabilized sleeve relative to a clipper anvil roll's cylindrical surface.

5 Claims, 2 Drawing Sheets

VENEER CLIPPER ANVIL ROLL JACKET AND RELATED METHODOLOGY

BACKGROUND AND SUMMARY OF THE INVENTION

This invention pertains to veneer clippers, and more particularly to an easily installable, removable and replaceable, resilient, knife-impact cover structure (jacket) for the surface of an anvil roll in a rotary veneer clipper.

A veneer clipper is a machine which is used in plywood plants throughout the world to clip veneer to width, and to clip out defects. Among a rotary veneer clipper's advantages are that it (a) is very simple mechanically, (b) requires minimum maintenance, (c) operates at very high veneer-flow speeds, (d) does not stop the flow of veneer when it produces a cut, (e) is computer controllable, and (f) is very accurate. Most plywood plants, certainly in North America, have adopted the rotary clipper as a machine of choice, and many rotary veneer clippers are also used in other countries of the world.

Such a clipper operates in the following manner. Veneer flows over a bottom anvil roll that is rotating in such a fashion that its peripheral speed is about the same as the speed that veneer is flowing through the machine. Typically, approximately 2-inches above the bottom anvil roll, and above the flowing veneer, is a flexible knife about ¼-inches thick and about 4-inches wide is held in place, stretched along the length of the roll by hydraulic cylinders which connect to the knife through thrust bearings. The knife is sharpened on both long edges, and nominally (when not cutting) is held stationary in generally a "horizontal-plane" position. Another anvil roll essentially exactly the same as the mentioned bottom anvil roll is mounted above the knife, and rotates at the same speed as does the bottom roll, but in the opposite direction.

When it is time to perform a cut, a computer control system controls servo-valves that cause hydraulic motors which are connected to each end of the knife to cause the knife to rotate through 180-degrees. In this rotation, as the knife goes through a "vertical plane" position, and because the top and bottom anvil rolls are adjusted to be closer together than the width of the knife, the knife is squeezed, or forced, through the veneer and into the bottom anvil roll, effecting a cut of the veneer. Because the knife is sharpened on both edges (so that it can cut every 180-degree turn) the knife also cuts into the top anvil roll.

To make such a clipper operate effectively, it has been necessary to make the associated anvil rolls very massive in order to contain and manage the cutting forces that are developed during a cutting operation. Typically, such anvil rolls are made of 9½-inch diameter solid steel. In the case of an 8-foot wide clipper, the steel for one roll weighs about 2,500-pounds.

Obviously a sharp knife for cutting wood cannot be permitted to drive into, and attempt to cut, steel, such as the steel in the anvil rolls. Therefore, it is conventional that anvil rolls are covered with a bonded polyurethane (or urethane) surface covering normally about ¾-inches thick. Such a surface covering has been proven to be very effective, and substantially all clippers employ this approach to protect the sharp edges of the knife, and to furnish suitable opposing "reaction" structures during a cutting operation. Unfortunately, the knife in a clipper does, gradually and eventually, cut away such a surface covering, and as a consequence, anvil rolls must be re-covered from time to time—typically about every about every three to nine months, depending upon machine operating parameters and history.

When it comes time to replace damaged anvil roll covers, the process currently employed is very problematic and often very costly. In addition to the not surprisingly high cost of shipping such large and heavy components back and forth for damaged-cover removal followed by cover replacement, the current process for cover replacement per se is itself quite involved and expensive.

Typically, rolls that are received for recovering are placed in a metal lathe, and the damaged cover material is removed using a sharp tool bit and the usual lathe tool feed mechanism. The roll is then scraped using a carbide tool scraper in the lathe tool holder, and then taken for sandblasting where a suitable hard sandblast material is employed further to clean the roll and to rough-up the surface for subsequent bonding of a new cover.

The sandblasted roll is then surface treated with a special bonding agent glue, and placed in an oven for overnight processing involving preheating to a temperature of over 200-degrees Fahrenheit.

After overnight heating, the roll is appropriately surrounded by a special mold, and urethane for a new cover is poured into a mold to form around the outside roughened surface of the now prepared and cleaned roll. The roll is then placed back in an oven and cooked for a period of about 8-hours, and thereafter removed and returned to the metal lathe machine. In this machine, an appropriate machining operation is then performed to size the outside surface of the new roll covering to the correct outside diameter. The roll is then prepared for return shipment to its owner.

The present invention uniquely addresses this complicated and costly prior art process of anvil roll recovering. As will be more fully explained shortly, the present invention, to address these prior art issues, features a wear-replaceable resilient cover structure for the known-diameter cylindrical surface of an elongate anvil roll having a known length. This cover structure includes (a) an elongate, tubular, cylindrical armature having inside and outside diameters which are each larger than the anvil roll's surface's known diameter, and (b) an elongate, tubular, cylindrical resiliency sleeve which embeddedly receives, and is stabilized by, the mentioned armature, and which possesses inside and outside diameters that are, respectively, less than and greater than those of the mentioned armature. The sleeve's inside diameter is sized to promote non-bonding, but somewhat frictionally resisted, slide-on/slide-off fitment of the armature-stabilized sleeve relative to the anvil roll's cylindrical surface.

The armature and sleeve combination may be prepared as a single, full-length unit which is constructed to cover the entire, intended coverable surface of an anvil roll, or this combinational armature and sleeve structure may be made in modular "sub-lengths" to be placed end-to-end as a "lateral stack" of covering elements ranging over the entire, intended coverable surface of an anvil roll. Preferably, the armature is formed of a perforate material which enables, during "mold-pouring" of the employed resilient sleeve material of the invention, that poured material to flow into and as a continuum through these perforations, thus to produce a very secure and stable embedment of the armature. Preferably, the armature is formed of an expanded perforate metal, and the embedding sleeve is formed of a molded polyurethane material.

These and other features and clear advantages of the structure of the present invention will become more fully apparent as the description thereof which now follows is read in conjunction with the accompanying drawings.

DETAILED DESCRIPTION OF THE INVENTION

Figure 1:
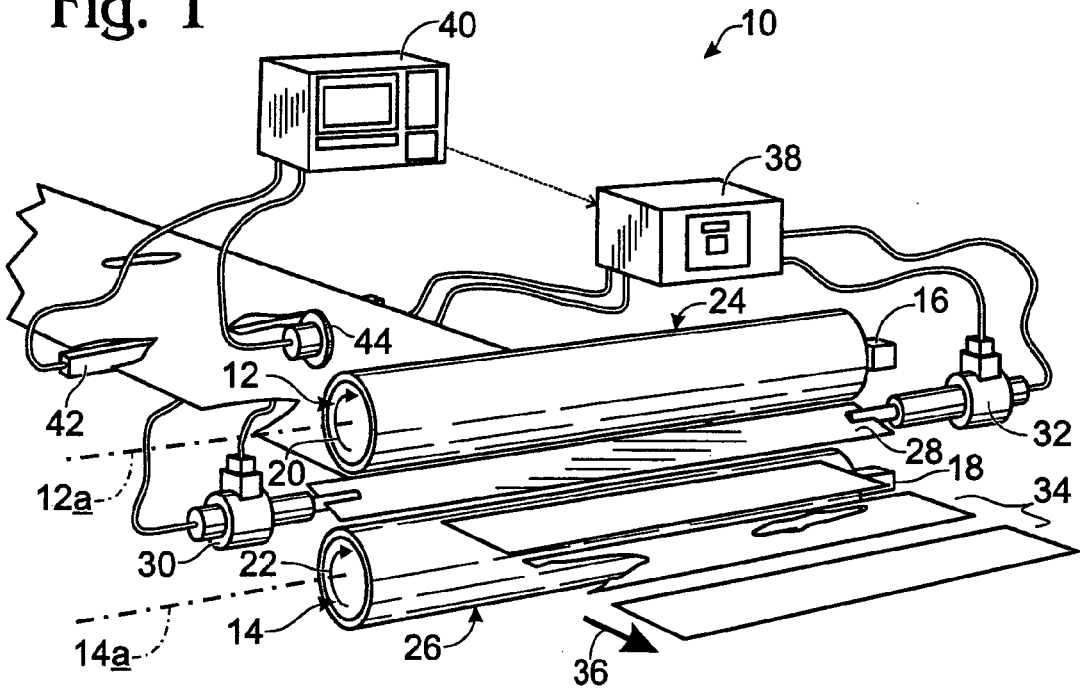
FIG. 1 is a fragmentary, isometric view of a veneer clipper having a pair of opposing, vertically spaced anvil rolls which are jacketed by resilient cover structures constructed in accordance with one preferred and best-mode (for certain applications) embodiment of the invention.

Turning now to the drawings, illustrated somewhat fragmentarily and schematically in FIG. 1 are portions of a veneer clipper 10 which, except for the incorporation therein of anvil rolls which bear cover structure made in accordance with one embodiment of the present invention, is otherwise conventional in construction. Appropriately mounted on the frame (not shown) in this clipper are upper and lower, counter-rotatively power-driven anvil rolls 12, 14, respectively, which are turned under power by suitable drive motors 16, 18, respectively, generally in the directions of the curved arrows shown at 20, 22, respectively. The rotational axis of upper anvil roll 12 is shown generally a 12*a*, and that of lower anvil roll 14 is shown generally at 14*a*.

Suitably frictionally yet (with some effort) slideably mounted on the respective outside cylindrical surfaces of anvil rolls 12, 14 are elongate, singular, tubular, resilient cover structures 24, 26, respectively, which are constructed and placed removeably on these rolls' outer surfaces in accordance with the present invention. As has just been mentioned, covers 24, 26, as pictured in FIG. 1, are singular in nature, with each of these covers having substantially the same overall lengths as those of their associated anvil rolls.

Figure 2:
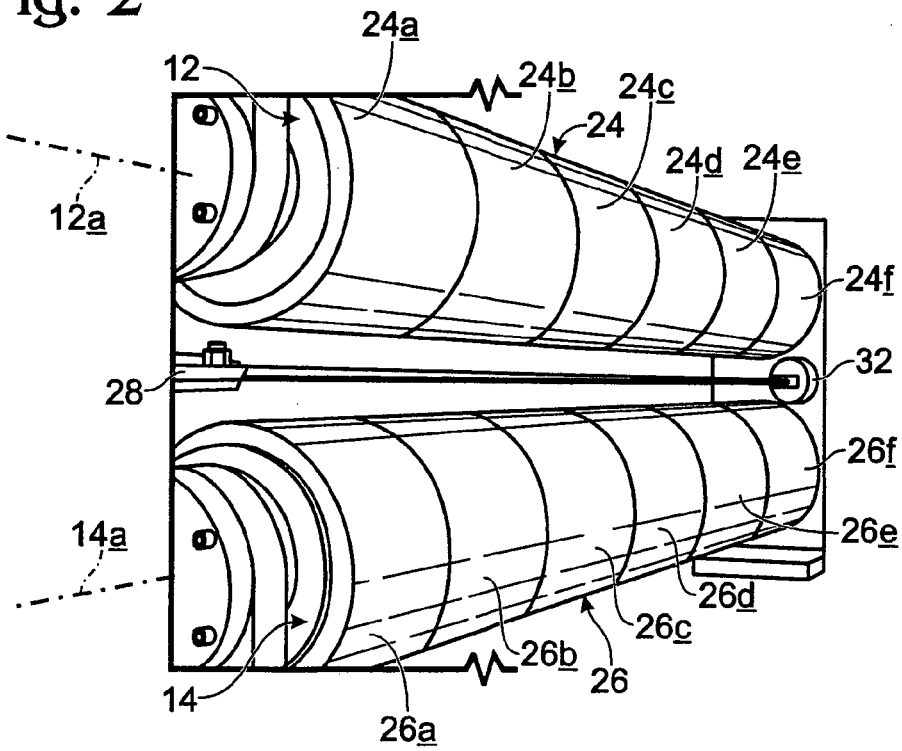
FIG. 2 is like FIG. 1, but here shows a modified form of anvil-roll cover structure constructed in accordance with another preferred and best-mode (for certain other applications) embodiment of the invention.

Digressing for a moment to FIG. 2 in the drawings, here there is shown a modified form of the invention, wherein each of these cover structures, 24, 26, instead of being singular in nature along substantially the entire length of an anvil roll, is made up of plural, elongate, tubular sections (or segments) which are "laterally stacked" in end-to-end abutment along the respective lengths of their associated anvil rolls. Thus, cover structure 24 in FIG. 2 is seen to include, as illustrated therein, six such sections 24*a*, 24*b*, 24*c*, 24*d*, 24*e*, 24*f*, and cover structure 26 is seen to include a similar collection of sections 26*a*, 26*b*, 26*c*, 26*d*, 26*e*, 26*f*.

In different specific applications, each of these two modifications of the invention may be preferable for a variety of reasons. The singular cover structure illustrated in FIG. 1 is useful wherein it is desired that only a single component make up such cover structure and where manufacturing of such a singularity is considered to be appropriate. Sectioning of a cover structure, as is illustrated in FIG. 2, may be appropriate in other instances wherein it is desired to manufacture and handle smaller cover units. Except with respect to axial lengths, the internal constructions and make up of the cover structures illustrated in both FIGS. 1 and 2 are essentially the same, and will be described more fully shortly.

Returning focus to FIG. 1, suitably, operatively and conventionally interposed the upper and lower anvil rolls is a double-side-edged veneer clipper blade 28 which is held under tension between a pair of end-attached blade-drive motors 30, 32 as generally shown in FIG. 1.

Illustrated generally at 34 in FIG. 1 is an elongate strip, or run, of wood veneer which is traveling through clipper 10 generally in the direction of arrow 36. As can be seen near the lower right side in FIG. 1, several cuts in this veneer strip have been made by clipper 10.

Further illustrated in FIG. 1 are other clipper and clipper-control components which are entirely conventional in construction. Very specifically, what are generally shown here are a computer 38, an appropriate display structure 40, a scanner 42 which looks for defects in a strip of veneer for the purpose of initiating a clipping operation, and a speed monitor in the form of a tachometer shown generally at 44. Various conventional interconnection lines are shown as freely flowing lines in FIG. 1 to indicate operative and information conveying connections between these various conventional structures as well between appropriate ones of these structures and knife-drive motors 30, 32.

Figure 3A:
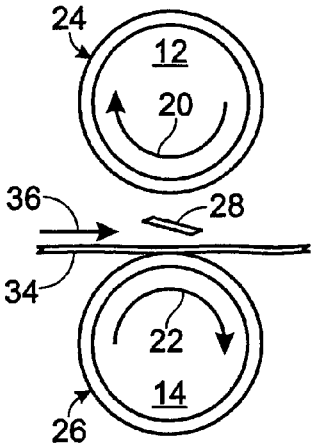
FIGS. 3A, 3B, 3C are enlarged, schematic, elevational views, taken generally as along the line 3—3 in FIG. 1, illustrating three different stages of knife/anvil-roll interaction during a single veneer-clipping (cutting) operation.
Figure 3B:
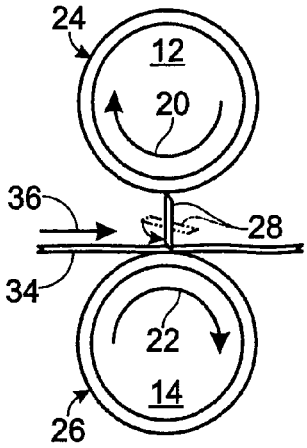
Figure 3C:
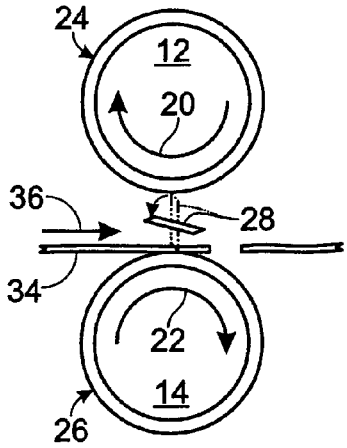

FIGS. 3A, 3B, 3C illustrate a typical clipping sequence in which blade 28 is quickly rotated from a condition occupying a generally horizontal plane (FIG. 3A) into a position occupying generally vertical plane (FIG. 3B) to produce a cut in veneer, and then quickly, in a continued direction of counterclockwise rotation, as pictured in FIGS. 3A, 3B, 3C, again to a substantially horizontal-plane condition (FIG. 3C). The blade pauses in such a horizontal-plane condition between cuts. When a cut is made, the opposite sharpened edges of the blade are driven essentially into the surfaces of resilient cushioning covers 24, 26, and with respect to engagement with cover 26, engages this cover in the process of penetrating and cutting a sheet of veneer overlying this cover (see particularly FIG. 3B).

Figure 4:
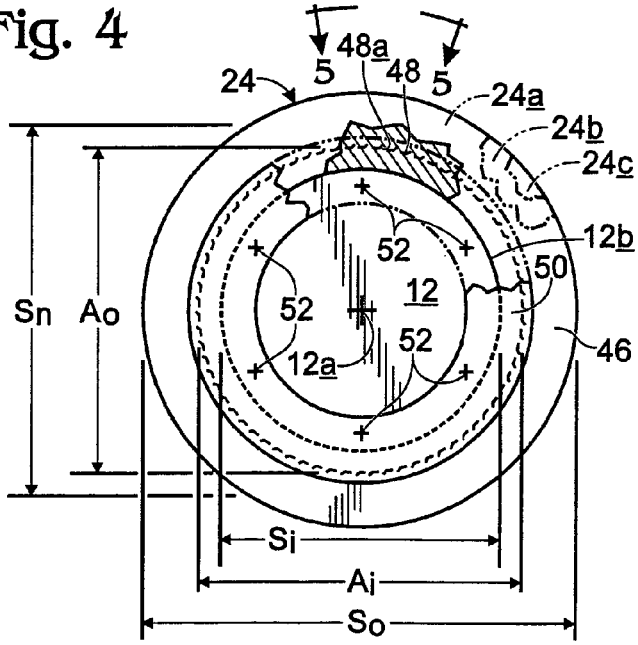
FIG. 4 is an enlarged end view of one of the anvil rolls bearing the anvil-roll cover structure employed in the veneer clipper of FIG. 1, with portions broken away to show detail.
Figure 5:
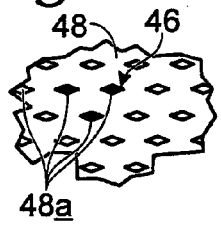
FIG. 5 is an enlarged, fragmentary, internal detail of the cover structure of the invention taken generally in the region of FIG. 4 which is bracketed by arrows 5—5.
Figure 6:
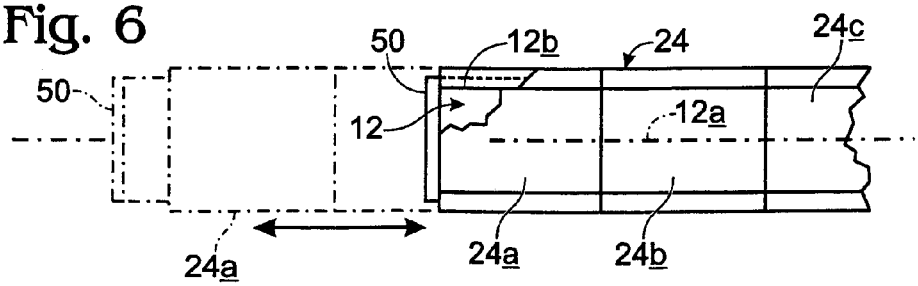
FIG. 6 is an exploded, simplified and schematic illustration, taken as if from the right side of FIG. 4, showing removal and replacement-installation of the form of anvil-roll cover structure which is pictured in FIG. 2.

Turning attention to FIGS. 4–6, inclusive, in the drawings, and describing in detail the specific construction provided for each of the resilient anvil roll covers in accordance with the present invention, FIGS. 4 and 5 are employed herein to illustrate effectively both modifications of the invention. FIG. 6 is presented to illustrate specifically the modification of the invention shown in FIG. 2. In FIG. 4, and ignoring for a moment the two dash-triple-dot lines in this figure, a singular cover structure is shown. Remembering that, except for overall length considerations, both embodiments of the invention have the same internal construction, this construction is now described just in the context of cover structure 24 as a singularity disposed on anvil roll 12.

Anvil roll 12 has a typical outside diameter of about 9½-inches, and a length of about 110-inches. The cylindrical outside surface of this roll is shown at 12*b* in FIGS. 4 and 6. The outside diameter of roll 12 is referred to herein as a known diameter, and its length which is to be covered is referred to herein as a known length.

Cover structure 24 is tubular and cylindrical in form, and herein has substantially the full length of roll 12. This cover structure includes a pair of components, one of which (a sleeve 46) embeds the other (an armature 48). Working from the inside out, armature 48 takes the form preferably of an elongate, cylindrical and tubular component which includes perforations, such as those shown at 48*a* in FIG. 5. Armature 48 is preferably formed of what is known as expanded metal. The exact form of this perforate structure, however, is not critical to practice of the present invention, and no effort is particularly made in FIGS. 4 and 5 to give a precision and to-scale picturing of any particular perforate metal structure. While perforate metal is described herein as the preferred material for making up armature 48, it should be understood that other perforate materials, which can act suitably as an imbedded and stabilizing armature within the sleeve of the invention, may be employed if desired and if appropriate to a particular application. In FIG. 5, three of the whole population of perforations 48*a* are shown intentionally darkened in order to illustrate the fact that the resilient sleeve material which embeds armature 48, in accordance with the invention, is prepared in such a fashion that it extends into and as a continuum through these perforations. This arrangement causes the armature and the sleeve to function as a stable, integrated whole.

Preferably, the nominal, or central, diameter of armature 48 as such is viewed axially as in FIG. 4, is just somewhat greater than the nominal outside surface diameter of anvil roll 12. A suitable nominal diameter for armature 48 might typically be about 9¾-inches. As viewed axially, the armature can be thought of as having nominal inside and outside diameters reflecting its effective radial thickness, and these nominal inside and outside diameters are shown in FIG. 4 generally at $A_i$ and $A_o$, respectively.

Sleeve 46 which embeds, and is thereby stabilized by, armature 48 takes the form of a molded tubular, cylindrical, elongate resilient urethane component which is preferably molded to its shape in a setting wherein the molding activity is performed so as to embed armature 48, with mold material (as just mentioned above) flowing through the perforations in this armature. In the setting now being described, sleeve 46 preferably has an inside diameter which very closely matches that of the outside surface diameter of roll 12, and preferably has such an inside diameter which promotes what is referred herein as a non-bonding resistance slide-on slide-off fitment relationship with respect to this roll's outside diameter. With such a size relationship established, the sleeve can, with a certain reasonable amount of effort, be slid onto and off of the outside surface of an anvil role, such as outside surface 12*b* in anvil roll 12. In this condition, the sleeve, during use in the operation of a veneer clipper, will remain substantially positionally stable on the outside of the associated anvil roll, but will nonetheless be easily removable when it comes time for replacement after it has been damaged and worn over a period of use.

Preferably, the diametral relationships that exist with respect to armature 48 and sleeve 46 are such that the armature's inside diameter is closer in dimension to the sleeve's inside diameter than is the armature's outside diameter to the sleeve's outside diameter. Further, is preferable that sleeve 46 have a central, or nominal, diameter which is roughly half way in value between its inside and outside diameters, with the armature's outside diameter being smaller in value than the sleeve's central or nominal diameter.

In FIG. 4, the sleeve's outside diameter is shown generally at $S_o$. In this same figure, the sleeve's inside diameter is shown generally at $S_i$. What has just been referred to as the sleeve's central, or nominal, diameter is shown in FIG. 4 generally at $S_n$, and it will be noted that previously mentioned outside diameter $A_o$ of armature 48 is less than this just-mentioned nominal diameter for the sleeve.

These diametral relationships result in a positioning for the stabilizing armature within sleeve 46 in a manner which causes these two cooperative elements to coact, during the operational life of cover structure 24, in what has been determined to be a most appropriate fashion. The armature is imbedded deeply enough from the outside diameter of the sleeve to avoid any direct striking by a veneer clipper knife, and yet is positioned between the inside and outside diameters of the sleeve, at sufficient distances spaced from both, wherein it can act as an effective configurationally stabilizing element in the overall cover structure.

Cover structure 24 is retained against axial shifting on anvil roll 12 by annular end retaining rings, such as the ring shown at 50 in FIGS. 4 and 6. These rings are appropriately bolted to the ends of the anvil roll at locations such as those generally indicated at 52 in FIG. 4. Each retaining ring, has an inside diameter which is clearly less than the outside diameter of the associated anvil roll, and an outside diameter which may be about the same as the outside diameter of armature 46. It is important, of course, that the outside diameter chosen for rings 50 be small enough to prevent the rings from being engaged by a clipper knife blade during a cutting operation.

Taking a slightly different point of view of FIG. 4, this view, in relation to the two dash-triple-dot lines presented at it lower right side, can be thought of as also illustrating the segmented, lateral-stack arrangement shown for cover structure 24 in FIG. 2. These lines represent cut-aways of nearby cover segments 24*a* and 24*b* to expose segment 24*c*, thus to illustrate the existence in this modification of the invention, and from an axial point of view, of the lateral-stack form of the invention.

As was mentioned earlier herein, a cover structure made in accordance with the invention is moved onto and off of the outside surface of an anvil roll through axial sliding motion. In the case where the anvil is covered by a singular cover structure, obviously just a single unit made in accordance with the invention is slid on to and off of the outside surface of an anvil roll during installation and removal operations, respectively. Where, however, a cover structure is made in accordance with what is specifically shown in FIGS. 2 and 6, and namely as a segmented structure, individual units are so slid on to and off of the outside surface of an anvil roll. This is clearly suggested by the solid and dashed line illustrations presented in FIG. 6.

The cover structure of this invention, also referred to herein as a wear-replaceable resilient cover structure, is thus proposed which deals very effectively with the issues of cost and complexity mentioned earlier herein relating to prior art approaches involving the installation and replacement of resilient covers on the outside surfaces of veneer-clipper anvil rolls. No longer is it necessary, when cover structure replacement is required, that an anvil roll be removed from a veneer clipper, and shipped bi-directionally for a complicated and labor intensive removal and replacement process. Rather, a worn cover structure, whether singular or segmented, is simply and easily removed by sliding it axially off from the outside surface of the associated anvil roll, and a new cover structure, again whether singular or segmented, is put into place by reversing this process, and namely by simply sliding the new componentry on to an anvil roll. The cover components which are removed and put back on by replacement are extremely light in weight and easy to handle, and do not, with respect to shipment between manufacturer and user, entail anything nearly like the handling and shipping cost issues which are associated with conventional anvil roll surface maintenance.

While various specific techniques and procedures may be used with respect to the fabrication of a cover structure made in accordance with the features of the present invention, one such practice which has been found to be very satisfactory, is now described.

It will probably be the case that a single diametral size (inside and outside) anvil roll cover structure will eventually suffice for all conventional clipper anvil rolls. Nonetheless, it may initially be the case that installation of a cover structure made in accordance with the present invention will occur under circumstances of replacing an originally bonded cover which is attached to an anvil roll with some unknown dimensions. If such is the case, a first step, which may be performed at the site of a clipper owner, or elsewhere, will involve carefully machining the outside cylindrical surface of an anvil roll to have a known outside diameter—typically about 9½-inches. Additionally, it will initially be necessary to prepare the opposite ends of the anvil roll with tapped bores that can receive bolts for securing cover retaining rings, such as ring 50. With these steps performed, then an anvil roll is essentially ready for the receipt and use of a resilient cover structure made in accordance with the present invention.

In a construction of an anvil roll cover in accordance with this invention, a reference anvil roll mold core is prepared having the appropriate length and outside diameter, and this mold core is built so as to be either always in place within, or to be easily placeable within, a suitable mold cavity. The outside surface of the mold core is initially wrapped with a suitable spiral wind of a cord material which furnishes a slight amount of spacing, typically about 1/16-inches, for holding away from the mold core surface the inner cylindrical surface of the perforate metal armature which is then next placed around the mold core.

This assembly including the mold core, the wrap of cord, and the perforate armature are then placed in the mold cavity, and an appropriate selected resilient polyurethane mold material in liquid form is poured, or otherwise introduced, into the mold cavity to create the imbedding sleeve. The pourable mold material flows through the perforations in the armature and into the space created between the armature and the mold core surface, imbedding and capturing both the spiral wind of cord and the armature.

While it may be the case that the mold forming the sleeve is constructed in such as fashion that a fully cured sleeve, after pouring of the mold material, will not require any additional surface finishing, there may be some practices where a small amount of final surface finishing is desired. In any event, essentially after curing of the mold material, a completed cover structure exists which can, with a certain amount of frictional resistance, simply be slid off axially from the mold core, and then shipped conveniently, as a relatively light-weight element, to the end user for slide installation of the cover onto the anvil roll in the subject clipper.

In relation to the sizes used for lengths and the various diameters of the materials that make up the cover structure of the invention, while it may well be the case that many, if not most, veneer clippers will have commonly same-size anvil rolls, such a size consideration is not any part of the present invention, and it is very clear that a cover structure made in accordance with the invention can be prepared to fit basically any conventional-size anvil roll—i.e., anvil rolls having different specific outside diameters and different specific lengths.

With respect to the preferred polyurethane material employed (typically a resin material) to create the resilient sleeve of the invention, the specific material chosen for use is certainly a matter of choice, but I have found that a material which exhibits, after curing, a 55D Durometer rating is quite appropriate. Whatever molding material is selected may, of course, be pre-mold blended with a suitable curing agent. It may also be the case that the particular resin employed for molding, after pouring, is most appropriately cured in a heated oven setting. All of these considerations with respect to the selection and handling of such a resin are entirely conventional.

As has already been mentioned with respect to the material to be employed for the reinforcing internal armature, while specifically described herein is a perforate metal material, it should be understood that various other materials, such a various plastic materials (as has been modestly suggested earlier), may be employed if desired.

With regard to the spacer cord which is described above as being wound on the mold core to provide an appropriate spacing between the outside surface of that core and the armature material, many different specific materials may be employed, and one that appears to work quite well is one made of an appropriate polyurethane material.

Accordingly, and while this method of building a cover structure possessing the features of the present invention has been determined to be a preferable and very workable approach, I recognize that there are various construction approaches which may be employed to create a resulting cover structure. None of these approaches is necessarily any component part of the present invention.

Thus, it should be apparent that a novel resilient easily removable re-installable replaceable etc. cover structure is proposed in accordance with the present invention for use as a protective covering on the surface of a veneer clipper anvil roll. The difficult and costly procedures involved heretofore with respect to replacement of a damaged roll cover are completely avoided, as are the attendant difficult and costly shipping and handling activities that are associated with the repetitive shipping and handling of large and heavy anvil rolls. Further, because of the fact that a replacement cover, assuming that an anvil roll has all of the appropriate sizing, can be put into place and use at the site of the subject veneer clipper, operational down time in a veneer plant is greatly minimized.

These and other features and advantages which are offered by the invention will certainly become apparent to those skilled in the art, as will various forms of modifications that may be made well within the spirit of the present invention. Accordingly, it should be considered that all such recognizable variations and modifications are deemed to come within the scope of the present invention.

I claim:

1. Wear-replaceable resilient cover structure for the known-diameter cylindrical surface of an elongate, known-length anvil roll in a veneer clipper comprising an elongate, tubular, cylindrical armature having inside and outside diameters which are each larger than such an anvil roll's surface's known diameter, wherein said armature is formed to have perforations, and an elongate, tubular, cylindrical resiliency sleeve embeddedly receiving, and stabilized by, said armature and possessing inside and outside diameters which are, respectively, less than and greater than those of said armature wherein said sleeve includes sleeve material extending into and through said perforations, said sleeve's said inside diameter being sized to promote non-bonding resistance slide-on/slide-off fitment of said armature-stabilized sleeve relative to the anvil roll's cylindrical surface.

2. The structure of claim 1, wherein said armature and sleeve possess like axial lengths, and said lengths are less than the known length of the anvil roll.

3. The structure of claim 1, wherein said armature's said inside diameter is closer in dimension to said sleeve's said inside diameter than is said armature's said outside diameter to said sleeve's said outside diameter.

4. The structure of claim 3, wherein said sleeve has a central diameter which is half-way in value between the sleeve's said outside and inside diameters, and said armature's said outside diameter is smaller in value than said sleeve's said central diameter.

5. The structure of claim 1, wherein said armature is formed of expanded perforate metal, and said sleeve is formed of molded polyurethane.

* * * * *